United States Patent [19]

Forsythe

[11] Patent Number: 4,561,649

[45] Date of Patent: Dec. 31, 1985

[54] ADJUSTABLE REST FOR THE FEET OF THE HUMAN BODY WITH OPTIONAL EXERCISE FEATURE

[76] Inventor: Marjorie A. Forsythe, 343 S. Dearborn, Room 1219, Chicago, Ill. 60604

[21] Appl. No.: 540,504

[22] Filed: Oct. 11, 1983

[51] Int. Cl.[4] ..... A63B 23/04; A63B 21/00; A63B 21/02

[52] U.S. Cl. ..... 272/96; 272/116; 272/135; 272/141; 272/144

[58] Field of Search ..... 272/96, 116, 135, 141, 272/55, 144, 145; 297/438, 439; 248/454–457

[56] References Cited

U.S. PATENT DOCUMENTS

| | | | |
|---|---|---|---|
| 1,180,057 | 4/1916 | McNamara | 248/456 |
| 1,452,915 | 4/1923 | Kennedy | 297/439 |
| 2,384,234 | 9/1945 | Breese | 297/438 |
| 2,991,126 | 7/1961 | Deady | 297/439 |

*Primary Examiner*—Richard J. Apley
*Assistant Examiner*—Kathleen D'Arrigo

[57] ABSTRACT

The invention involves an adjustable rest for the feet, and includes a portion which may be used for exercising portions of the feet. The construction is such that it may be folded into a substantially flat configuration to enhance its portablility and to reduce the cost of manufacture and its selling price.

10 Claims, 7 Drawing Figures

FIG. 1
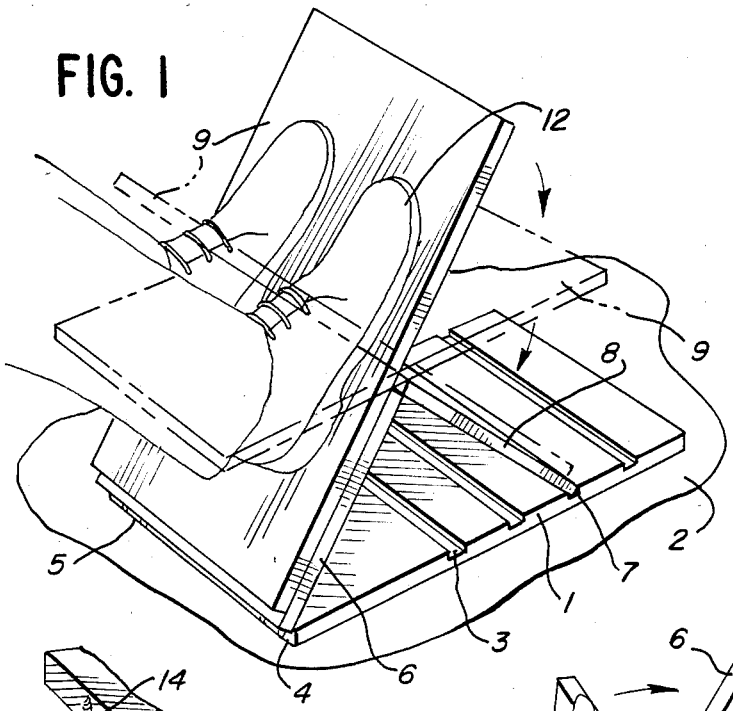
FIG. 2
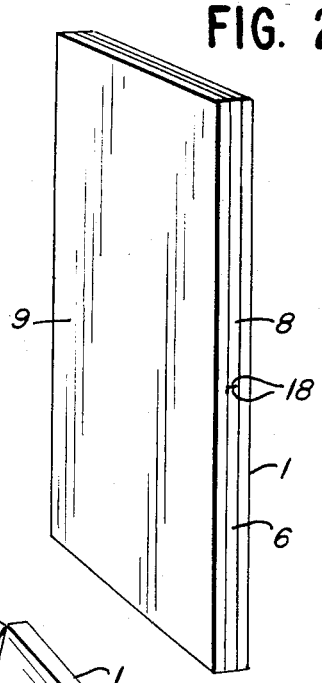
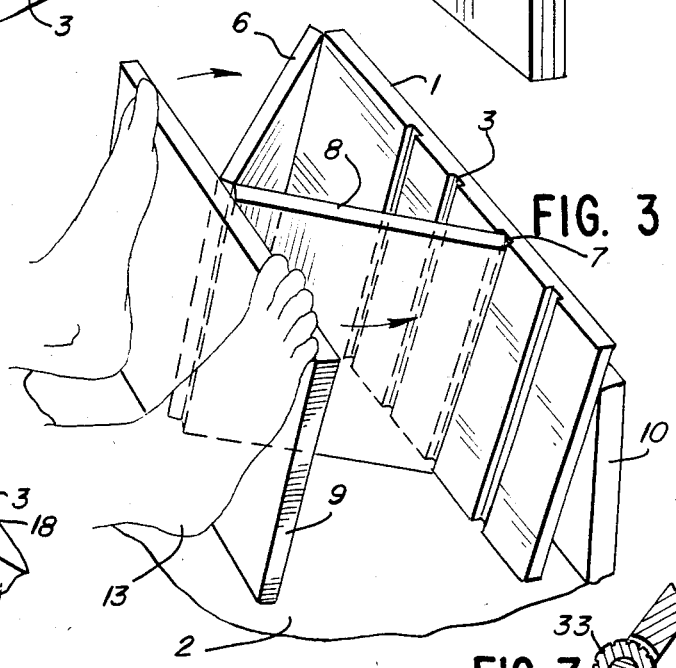
FIG. 3
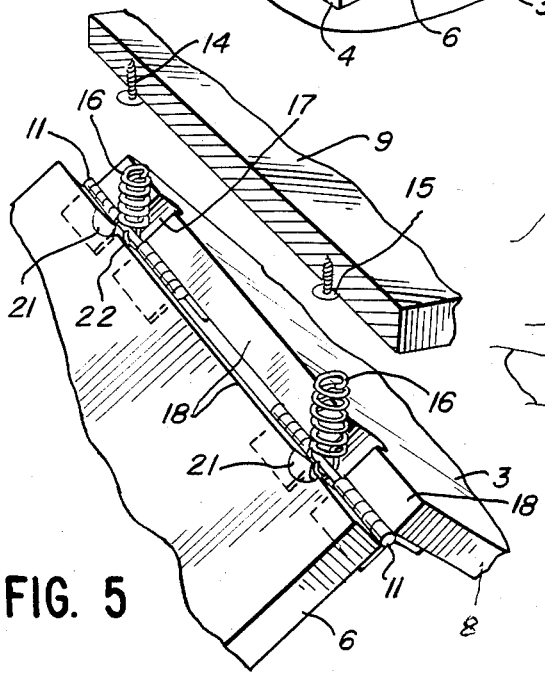
FIG. 5
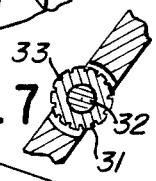
FIG. 7
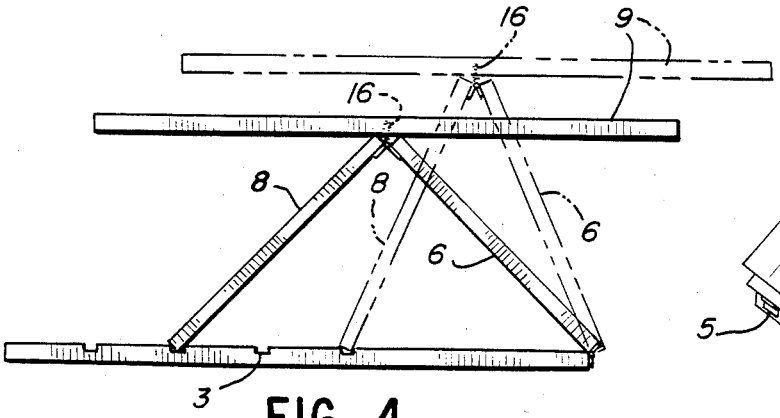
FIG. 4
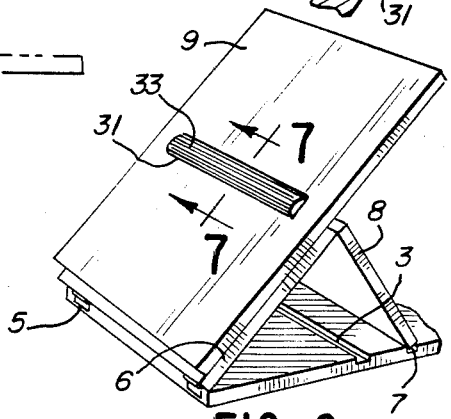
FIG. 6

ADJUSTABLE REST FOR THE FEET OF THE HUMAN BODY WITH OPTIONAL EXERCISE FEATURE

BACKGROUND OF THE INVENTION

1. Field of the Invention

The invention relates to a rest for the feet and legs of the body which can be readily adjusted for height and slope and may also be used to exercise the feet and legs. It is primarily intended for use by people who are required to sit or lie in substantially the same position for prolonged periods of time, such as at office desks.

2. Summary of the Prior Art

The Prior Art discloses various devices for providing adjustable foot, back and head rests, but none provide the ability of adjusting and folding into a flat position with a minimum of effort and none disclose a rest for parts of the human body combined with the ability of the user to simultaneously provide both for adequate and satisfactory rest and the ability to exercise if the latter is desired. Furthermore, the prior art devices are cumbersome, heavy and expensive in construction, and lack in aesthetic appeal. The specific prior art known to the applicant is listed and discussed in the attached prior art statement which refers to the following prior U.S. patents.

Kennedy: No. 1,452,915; Apr. 24, 1923;
Burkholder: No. 2,341,080; Feb. 8, 1944;
Bloomquist: No. 2,884,991; May 5, 1959;
Revercomb: No. 2,556,498; Sept. 4, 1951;
Deady: No. 2,991,126; July 4, 1961;
Drabert et al; No. 3,653,715; Apr. 4, 1972.

SUMMARY OF THE INVENTION

The present invention provides a rest for the feet and legs of the human body, and is particularly adapted to rest and if desired, to exercise the feet of the user. There is provided a rest and exercise device which may be readily formed of a variety of materials such as wood, plastic, metal or impregnated wood or paper materials. The parts are symmetrical in shape, readily assembled and foldable into a flat configuration which is extremely portable and may be placed in a simple and light case for carrying the device. The foot rest provides for the adaption of a healthy, non-tiring posture by those, for example, who sit at desks and office machines.

BRIEF DESCRIPTION OF THE DRAWINGS

FIG. 1 is a perspective view of the device in the unfolded or open position thereof being used as a foot rest and, is desired, as an exercise device by the user by a person sitting, for example, at a desk or office machine, the dot and dash lines illustrating an alternate position of the portion on which the feet rest.

FIG. 2 a perspective view of the device shown in FIG. 1 in its folded or carrying position;

FIG. 3 is a perspective view of the device shown in FIG. 1 turned at a 90° angle to the showing in FIG. 1 and being used primarily as an exercise device for the feet and legs of a human;

FIG. 4 is a side elevational view of the device shown in FIG. 1;

FIG. 5 is an enlarged partial sectional exploded view of the parts used to connect the various parts of the device together to afford movement thereof to different desired positions;

FIG. 6 is a perspective of the device shown in FIG. 1 including a roller partially protruding from the top surface of the portion of the device which a foot or feet engage to assist in changing the position of the foot or exercising the same; and FIG. 7 is a partial sectional view taken on line 7—7 of FIG. 6.

DESCRIPTION OF THE PREFERRED EMBODIMENTS

The device shown in FIGS. 1 to 5 is depicted as a combined foot rest and exercise apparatus, although, as stated, it has many other uses and it is not intended to be limited to that use only, unless such limitation is included in the claims hereof.

FIGS. 1 to 5 comprise a flat member 1 of any desired shape which is adopted to be placed on the floor of a supporting structure shown diagrammatically by the numeral 2. The member 1 is provided with a plurality of inclined notches 3 extending transversely across the member substantially paralled to an edge 4 of the member 1 to which it is preferable hingedly attached at 5 to a fixed flat member 8 in a manner best shown in FIG. 5 by hinges 11, and is provided with an edge 8 which is intended to be inserted in the desired notch, to adjust the angle between members 6 and 8.

A fourth preferably flat member 9 which is engaged by the user's shoes 12 (FIG. 1) or bare or stockinged feet 13 (FIG. 3) when the device is used for exercise is attached to the members 3 and 6 by screws 14 having heads 15 which retain coiled springs 16 which are housed in cavities 17 provided in the edges, 18 of rotatable member 3. This provides resistance to tilting of member 9, the amount of such resistance depending upon the strength of the springs which may be varied. The springs 16 may be secured at 22 to shafts 21 for hinges 11 which hinge the members 6 and 8 together.

The assembly is sufficiently compact so that the entire device including all four member's 1,3,6 and 8 may be folded into a flat configuration as shown in FIG. 2 for ready transport or wrapping.

In the position shown in FIG. 1, the device is adapted to be used as an adjustable foot rest, for example at a desk. However, if one position becomes uncomfortable, the position of the edge 7 may be shifted in the notches 8, thus changing the angle between members 6 and 8. Also the entire device including member 9 may be turned 90°, for example. In the position shown in FIG. 3, which is supported on 2 which may in this case, a bed. A backstop 10 may be provided to prevent shifting of the device on the support 2. FIG. 4 shows two positions of same from the side.

Another embodiment or addition to the invention is shown if FIGS. 6 and 7. As shown, a roller 31 is secured in the foot supporting member and on a fixed shaft 32 so that the user may slide the feet relative to member 9. Also serrations 33 may be provided on the roller 31 to impart a scratching or tingling sensation to the bottom of the feet when used as shown in FIG. 3.

From the foregoing it will be seen that the invention is one well adapted to attain all the ends and objectives hereinbefore set forth together with other advantages which are obvious and inherent in the structures.

It will be understood that certain features and subcombinations are of utility and may be employed without reference to other features and subcombinations. This is contemplated by and is within the scope of the appended claims.

In as many possible embodiments of the invention may be made without departing from the scope thereof, it is to be understood that all matter herein set forth or shown in the accompanying drawings is to be interpreted as illustrative and not in a limiting sense.

What is claimed is:

1. A device for resting and exercising feet of the human body which is to be placed on a supporting member, said device comprising a first member adapted to be placed on said supporting member, second and a third members, means for rotatably connecting said second and third members together, means for connecting the second member rotatably adjacent to one end of the first member, means on said first member for providing adjustment of the angle between said second and third members, means on said third member adapted to cooperate with the adjustment means on the first member to afford said angle adjustment between the second and third members, a fourth member upon which the feet of the human body are placed for rest and exercise, and means for securing said fourth member to the second and third members contiguous with the connecting means between them, said securing means being located substantially at the midpoint of said fourth member.

2. A device as claimed in claim 1 wherein the means connecting the fourth and the second and third members is rotatable.

3. A device as claimed in claim 2 wherein the last mentioned rotatable connecting means includes means for exerting pressure against rotation thereof.

4. A device as claimed in claim 3 wherein resilient means provide the pressure exerting force.

5. A device as claimed in claim 1 wherein the first member is provided with a plurality of indentations with which an edge of the third member engage at a position desired by the user.

6. A device as claimed in claim 1 wherein means are attached to the fourth member to frictionally engage the feet of the human body contacting the fourth member.

7. A device as claimed in claim 6 wherein means are attached to the fourth means comprising a rotatable roller protruding from the surface of the fourth member.

8. A device as claimed in claim 7 wherein the roller is provided with a rough surface.

9. A device as claimed in claims 1 or 3 wherein the connecting means for the first and second members, and the connecting means for the second and third members are positioned so that the various members may be folded to provide a flat configuration.

10. A device as claimed in claim 9 wherein the fourth member is attached to the second and third member so that it may be folded into a completely flat configuration with the first, second and third members without protuberances on any surface.

* * * * *